US005753390A

United States Patent [19]

De Roo et al.

[11] Patent Number: 5,753,390

[45] Date of Patent: May 19, 1998

[54] METHOD OF PREPARING DISPERSIONS OF PHOTOGRAPHICALLY USEFUL COMPOUNDS

[75] Inventors: Pierre De Roo, Schoten; Jan Gilleir, Mortsel, both of Belgium

[73] Assignee: Agfa-Gevaert, N.V., Mortsel, Belgium

[21] Appl. No.: 682,356

[22] Filed: Jul. 17, 1996

Related U.S. Application Data

[60] Provisional application No. 60/003,588 Sep. 12, 1995.

[30] Foreign Application Priority Data

Jul. 24, 1995 [EP] European Pat. Off. ..... 95202034

[51] Int. Cl.[6] ..... G03C 1/015; G03C 1/025; G03C 1/38; G03C 7/388

[52] U.S. Cl. ..... 430/3; 430/449; 430/517; 430/522; 430/546; 430/566; 430/631; 430/935; 252/363.5; 241/16; 23/295 R

[58] Field of Search ..... 430/546, 631, 430/449, 522, 566, 517, 935, 3; 252/363.5; 241/16; 23/295 R

[56] References Cited

U.S. PATENT DOCUMENTS

| | | | |
|---|---|---|---|
| 4,855,221 | 8/1989 | Factor et al. | 430/522 |
| 5,158,863 | 10/1992 | Bagchi et al. | 430/546 |
| 5,182,189 | 1/1993 | Bagchi et al. | 430/546 |
| 5,326,687 | 7/1994 | Texter | 430/522 |
| 5,437,970 | 8/1995 | Shono | 430/522 |
| 5,455,155 | 10/1995 | Brick et al. | 430/631 |
| 5,460,933 | 10/1995 | Brick et al. | 430/631 |
| 5,478,705 | 12/1995 | Czekai et al. | 430/546 |
| 5,609,998 | 3/1997 | Texter et al. | 430/449 |
| 5,624,467 | 4/1997 | Texter et al. | 430/546 |

*Primary Examiner*—Richard L. Schilling
*Attorney, Agent, or Firm*—Breiner & Breiner

[57] ABSTRACT

A method is described for preparing a concentrated dispersion of a photographically useful compound ready-for-use in coating solutions of hydrophilic colloid layers of a silver halide photographic material, wherein said compound has at least one ionisable acid site on its molecule, the said method comprising the steps of deprotonising and solubilising the said compound in alkaline medium; microprecipitating the said compound and milling the microprecipitated compound obtained, coating the said dispersion of a photographically useful compound in non-light-sensitive and/or light-sensitive hydrophilic layers of a silver halide photographic material, wherein milling proceeds during and/or after the microprecipitating step.

14 Claims, No Drawings

METHOD OF PREPARING DISPERSIONS OF PHOTOGRAPHICALLY USEFUL COMPOUNDS

DESCRIPTION

Benefit is claimed under 35USC119(e) from provisional application 60/003,588 filed Sep. 12, 1995.

FIELD OF THE INVENTION

The present invention relates to methods of preparing dispersions of photographically useful compounds ready-for-use in coating solutions of hydrophilic layers of photographic materials, said compounds having ionisable acid sites on their molecules.

BACKGROUND OF THE INVENTION

Photographically active ingredients for use in one or more hydrophilic layers of silver halide photographic materials, whether or not light-sensitive, are well-known. Particularly well-known ingredients are dyes which can be used as filter dyes, accutance dyes or antihalation dyes, stabilisers, coloured or uncoloured couplers, colour coupler precursors, developing agents, development activators and deactivators, hardeners, sensitisers or desensitisers.

One of the objects has therefore always been to bring the said ingredients in a suitable dispersed form in the said layers.

One of the possibilities to reach that goal consists in the production of solid particle dispersions of water insoluble compounds as has been extensively described e.g. for dyes in EP-A's 0 384 633 and 0 351 593; further in granted EP-A's 0 323 729; 0 274 723; 0 276 566 and U.S. Pat. Nos. 4,900,653; 4,904,565; 4,949,654; 4,940,654; 4,948,717; 4,988,611 and 4,803,150.

One of the objects has therefore always been to bring dyes in a suitable dispersed form in the said layers.

Normally storage dispersions of the said solid particle dispersions are formed in aqueous gelatinous medium by means of ball milling, sand milling, roller milling and other techniques. Said techniques have no economical interest as long as milling times from 6 to 24 hours and even up to 72 hours are not exceptional. The mechanical load therein is very hard as temperature increases may lead to a partial destruction of the dyes. Especially when a gelatinous dispersion is made from a mixture of dyes, necessary to get the desired absorption wavelength spectrum, milling techniques are leading to blocking of the mechanical process as the viscosity is increasing dramatically. Moreover a long preparation time makes a preparation "directly ready-for-incorporation in coating solutions" impossible. The dispersions should be stored and desintegration of the dispersing colloid and/or agglomeration of the particles may occur. To avoid the mechanical load during the preparation of the dispersions, as has been described hereinbefore, attempts have been made to provide dispersions of dyes by means of the so called "microprecipitation technique". Microprecipitation techniques have e.g. been described in DE-PS 932 343, in EP-A's 0 015 601, 0 019 299, 0 323 729, 0 549 486 and 0 549 489; in JP-A 61-185568; in GB's 1,210,253 and 1,305,441 and in U.S. Pat. Nos. 4,970,139; 5,075,205; 5,077,184; 5,089,380; 5,104,776; 5,155,015 and 5,182,189.

From EP-A 0 549 486, microprecipitated dispersions comprising a methine oxonol filter dye are well-known. In the said EP-A there is referred to U.S. Pat. No. 4,855,224 wherein reprecipitation of dyes is believed to be an unsuitable technique in the preparation of filter dye dispersions.

From EP-A 0 549 489, a microprecipition technique with acidic protons of filter dyes is known, wherein use is made during the acidifying step of a dispersing aid, which is preferably added to the filter dye composition prior to acidification and wherein milling techniques are excluded.

The said dispersing aid is a stabiliser, a dispersant, a surfactant, a polymeric colloid or a mixture of them.

Dispersions of dyes and other photographically useful compounds having ionisable acid sites on their molecules prepared according to the microprecipitation technique, especially when starting from a concentrated slurry in aqueous medium, are usually containing big agglomerated particles and the microprecipitation is carried out at a high concentration. As a consequence such dispersions are not suitable as ingredients for coating solutions of hydrophilic layers in photographic materials comprising photographically useful compounds having ionisable acid sites on their molecules.

OBJECTS OF THE INVENTION

Therefore it is an object of this invention to obtain concentrated dispersions of photographically useful compounds having ionisable acid sites on their molecules, ready-for-use in coating solutions of hydrophilic layers of photographic materials.

It is a further object of this invention to get dispersions having particles with a sufficiently small mean particle diameter, having a small number of agglomerated particles.

Other objects will become apparent from the detailed description and the examples disclosed hereinafter.

SUMMARY OF THE INVENTION

According to this invention a method is described for preparing a concentrated dispersion of a photographically useful compound ready-for-use in coating solutions of hydrophilic colloid layers of a silver halide photographic material, wherein said compound has at least one ionisable acid site on its molecule, the said method comprising the steps of deprotonising and solubilising the said compound in alkaline medium, microprecipitating the said compound and milling the microprecipitated compound obtained, coating the said dispersion of a photographically useful compound in non-light-sensitive and/or light-sensitive hydrophilic layers of a silver halide photographic material, wherein milling proceeds during and/or after the microprecipitating step.

DETAILED DESCRIPTION OF THE INVENTION

In the context of this invention the term "dispersion of photographically active or photographically useful compound(s) or ingredient(s)" for use in one or more hydrophilic layers of silver halide photographic materials is related with filter dyes, accutance dyes or antihalation dyes, stabilisers, coloured or uncoloured (colourless) couplers, colour coupler precursors, developing agents, development activators or deactivators, hardeners, sensitisers or desensitisers. Particularly if the photographically useful compound is a dye the term "dispersion of at least one dye" has to be interpreted, if more than one dye is present in the said dispersion, as resulting from a mixture of "microprecipitated dispersions", microprecipitated separately, or as resulting from a mixture of at least one "co-microprecipitated dispersion", wherein both mixtures are milled during and/or after the microprecipitation step, according to the method of this invention. In particular according to the method of this invention dispersions are prepared of merostyryl dyes, oxonol dyes, developing agents, activating agents or deactivating agents . . . etc., without however being limited thereto.

Said "microprecipitate" is obtained by the method of acidifying an aqueous alkaline solution of photographically useful compounds having ionisable acid sites on their molecules, that are deprotonised in alkaline medium and, as a consequence, that are solubilised. During microprecipitation it is preferable to have an input of energy, resulting in thoroughly mixing the alkaline solution of photographically useful compounds and the acidic solution at the moment that the alkaline solution is brought into contact with the acidic solution. Preferably said mixing is provided by "low shear mixing", "high shear mixing" or "axial-flow impeller mixing".

Examples of "high shear mixers" are "Ultra Turrax" (Janke & Kunkel) and "Misch Sirene" (Kotthoff) . From the literature well-known types of "axial-flow impellers" are e.g. a Rushton turbine, an anchor impeller, a blade or paddle impeller, described in Chem. Eng. Sc., Vol. 47 (1992), p. 1401–1410. The impellers are therein driven by a variable speed motor (Zeromax, Model K, Zeromax Inc., Toronto). Effects of impellers are e.g. described in Chem. Eng. Progress, February 1994, p. 45–48. Ultrasonic transducers are the "Branson Liquid Processor" and the "Branson Sonifier 250", a schematic view of which is described on p. 83 and 88 respectively in the Engineer's Thesis "Ultrasound Dispersing", Univerity of Leuven, Belgium, 1987/1988 from B. Horsten.

In a further embodiment an ultrasound apparatus is optionally combined with at least one part of the apparatus in which the microprecipitate is formed or collected after precipitation.

Combinations of different sources, providing energy input during and/or after microprecipitation, can be applied. The said energy can also be made variable by changing the parameters, changing the input energy in one apparatus, whether or not combined with another one, as e.g. by changing the stirring rate of a stirrer, by changing the dimensions of the mixing vessel (diameters, heights, distances, . . . ), flow rates etc. . . . So in Perry's Chem. Eng. Handbook p. 19–22, a description is given of a suitable apparatus as e.g. the "Kenics static mixer" (Chemineer, Inc.) and the "Sulzer static mixer" (Koch Engineering Co., Inc.).

Moreover application of dedicated energy input according to the method of this invention is possible batch-wise or in a continuous preparation.

So the microprecipitation step making part of the method used in this invention may be carried out in a small "nucleation" vessel, wherein small amounts of acid solutions are continuously injected at a controlled rate into the alkaline solution of a solubilised photographically useful compound which is flowing at a predetermined rate throughout the said "nucleation vessel" to a larger vessel, collecting the microprecipitated compound(s). In the said larger vessel suitable ingredients like e.g. a dispersing agent, a solvent, a binder or a combination thereof, may be present which should be avoided in the nucleation stage or which should be present there in much lower concentrations than before the milling step, especially when the microprecipitated dispersion should be stored for some time before being coated on a film support or substrate. In a continuous preparation process an ultrasound treatment step can be applied in the "nucleation vessel", in the mains connecting the said "nucleation vessel" and a "collecting vessel" or in the "collecting vessel".

Otherwise the dispersion can be formed batch-wise in one vessel by microprecipitation. This discontinous process can be interrupted at whatever a stage of the microprecipitation step in order to change e.g. mixers, in order to start an ultrasound treatment for a well-defined time period, etc. An ultrasound treatment step during and/or after the microprecipitation step is highly preferred in many cases.

Combinations of energy input are thus possible in order to get a predictable average size and size distribution for the particles of the dispersion of photographically useful compounds.

Aqueous solutions of photographically useful compounds used in the method according to this invention are made alkaline with a base as e.g. sodium hydroxide or potassium hydroxide. In the neutralization step organic acids as acetic acid, propionic acid and the like are used or diluted inorganic acids as hydrochloric acid, sulphuric acid or phosphorous acid.

In the microprecipitation step of the dispersion preparation, wherein the microprecipitate formed is milled during and/or after the microprecipitating step, according to the method of this invention the said microprecipitation step is performed in the presence of at least one dispersing agent, at least one hydrophilic colloid or a mixture thereof.

In the case wherein the said microprecipitation step is performed in the absence of a dispersing aid, such as a dispersing agent and/or a hydrophilic colloid, the said agent and/or colloid is added during the milling step, following the microprecipitation step.

Suitable hydrophilic colloids therefore are e.g. gelatin, colloidal silica sol, and synthetic, semi-synthetic, or other natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers. Natural substitutes for gelatin are e.g. other proteins such as zein, albumin and casein, cellulose, saccharides, starch, and alginates. In general, semi-synthetic substitutes for gelatin are modified natural products as e.g. gelatin derivatives obtained by conversion of gelatin with alkylating or acylating agents or by grafting of polymerisable monomers on gelatin, and cellulose derivatives such as hydroxyalkyl cellulose, carboxymethyl cellulose, phthaloyl cellulose, and cellulose sulphates. The said hydrophilic colloid should dispose of an acceptably high number of functional groups, which by reaction with an appropriate hardening agent can provide a sufficiently resistant layer after coating. Such functional groups are especially amino groups, but also carboxylic groups, hydroxy groups, and active methylene groups.

Solvents can also be used as e.g. methyl alcohol, ethyl alcohol, isopropyl alcohol, tetrahydrofuran, dimethylformamide, dioxane, N-methyl-pyrrolidone, acetonitrile, ethylene glycol, ethyl acetate, tetrahydrofuran etc., the proviso that the solution comprises a solution of a surfactant in water containing a polymer, ionisable by base.

Suitable dispersing agents used in the microprecipitation step of the dispersion preparation method according to this invention are an ionisable polymer and/or an amphoteric and/or a surface active agent. Surface-active agents having a hydrophobic moiety e.g. a long-chain aliphatic group or an aliphatic-aromatic group and a hydrophilic moiety e.g. an anionic or cationic group, an amphoteric group or a non-ionic group as ethylene oxide groups are suitable. They include surface anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, amine-N-oxides; cationic agents such as alkylamine salts, aliphatic, aromatic, or heterocyclic quaternary ammonium salts, aliphatic or heterocyclic ring-containing phosphonium or sulphonium salts. The said agents especially have the function of facilitating the dispersive emulsification of ingredients in silicic acid during the preparation procedure. These surface-active compounds may e.g. be added to the reaction vessel, to the aqueous alkaline solution whether or not containing an organic solvent of the photographically useful compound to be dispersed or may be divided between those two solutions. Especially preferred are ampholytic compounds such as 2-N,N,N-trialkylamino acetic acid. The dispersing agents, if present, are preferably present in amounts from 0.1 to 20% by weight versus the amount of the dye.

If the microprecipitation step making part of the method used in this invention is carried out in a milling vessel, small amounts of acid solutions are continuously injected at a controlled rate into the alkaline solution which is flowing at a predetermined rate throughout the said vessel to a collector, collecting the simultaneously microprecipitated and milled photographically useful compound(s). In the said collector suitable ingredients, like e.g. a dispersing agent, a solvent, a hydrophilic colloid or a combination thereof, may be present which, for whatever a reason are avoided in the "microprecipitation and milling step" or are present therein in much lower concentrations. In order to further reduce the formation of agglomerates in the "microprecipitation and milling step, during and/or after microprecipitation" characteristic for the method according to this invention an ultrasound treatment step is recommended, to be performed during and/or after the said microprecipitating step and/or milling step, especially when lower amounts of hydrophilic colloid are used e.g. for reasons of viscosity. It is e.g. possible to have an ultrasound treatment step in the collector after the said "microprecipation and milling step, during and/or after microprecipitation".

The milling step is performed during and/or after the microprecipitation process by the well-known mechanical milling techniques such as e.g. ball milling, roller milling, pearl milling, basket milling or microfluidizing, the said step being performed in the corresponding "milling apparatus" as in the so-called "ball-mill", "sand-mill", "pearl-mill", "basket-mill" or "roller-mill" apparatus, the said apparatus however not being limited thereto. The photographically useful compounds are therein, apart or together, preferentially microprecipitated and milled, during and/or after microprecipitation in the presence of gelatin. The presence of hydrophilic colloids differing from gelatin is thereby not excluded. Suitable hydrophilic colloids are the same as given hereinbefore.

Preparation methods according to this invention of (a) dispersion(s) of photographically useful compounds are leading to particle sizes of the dispersion(s) smaller than 500 nm. To reach a particle size of not more than 500 nm by only applying an acidifying step of alkaline solutions (coating solutions or separate solutions containing at least one photographically useful group) microprecipitation in well-defined pH-conditions is required. Therefor a pH-stat apparatus can be used to control these conditions, but the rate at which the acidic solutions are added is important too. Both conditions are not only determining the ultimate particle size of the microprecipitated particles, but are also determining the photographic activity as in the case of e.g. for dye particles, wherein they are determining the absorption over a specific wavelength region e.g. from 370 to 700 nm, depending on their chemical structure. According to this invention application of a milling step during and/or after microprecipitation is thus required in order to further make the size of the particles decrease.

As a result it is possible to reach particle sizes of from 0.05 to 0.50 μm and more preferably from 0.10 to 0.45 μm in an economically justifiable manner, without the presence of unwanted agglomerates. Unwanted agglomerates make a filtrating process before addition of dispersions to coating solutions necessary and are responsible for the presence of coating failures. Opposite thereto, in the case of e.g. dyes in dispersed form, prepared according to the method of this invention, a remarkable enhancement of the absorption efficiency thereof is observed, an improvement of the transparency of the hydrophilic layers of the photographic material wherein they are coated and a reduction of scattering of incident light, thus further improving sharpness as a result.

In the case of e.g. dyes, amounts which are generally used in hydrophilic layers of photographic materials are from 10 to 500 mg/m$^2$ and, more preferably, from 100 to 300 mg/m$^2$.

In the case of e.g. dye dispersions preferred absorption densities in well-defined wavelength region of e.g. 370 to 700 nm, are at least 0.3, and, more preferably, at least 0.6. It is evident that more finely dispersed dye particles require a lower coating amount of the said dyes in order to reach the preferred absorption densities. Moreover in an alkaline developer, during processing of a silver halide photographic material comprising dyes, prepared according to the method of this invention, it is evident that finer alkali soluble dye particles are decolored more quickly and are more easily removed from the silver halide photographic material. It is clear that this is in favour of rapid processing applications of the photographic materials in which e.g. dye dispersions, prepared according to the method of this invention, are coated.

In order to remove salts generated during microprecipitation a desalting step after the microprecipitating step is recommended especially to reduce coating failures due to the presence of said salts. The presence thereof can lead to e.g. sticking phenomena. Said desalting step is preferably performed by means of e.g. dialysis, ultrafiltration etc., without however being limited thereto.

According to the method of this invention it is possible to get high concentrations of photographically active compounds in dispersed form: suitable concentrations are from 0.5 to 15% by weight, more preferably from 1 to 10% and still more preferably from 2 to 10%. Application of the desalting techniques mentioned above is recommended in order to enhance said concentrations.

The advantages resulting from the use of dispersions of photographically useful compounds prepared by the method of this invention is not only related with economic aspects, as e.g. concentration enhancement and storage ability, but also to the fact that lower amounts of hydrophilic colloid(s) can be used. As said amounts of hydrophilic colloid(s) are introduced into coated hydrophilic layers, together with the dispersion, the reduction of said amounts is highly preferred e.g. in applications wherein very thin layers, substantially free from gelatin used as a binder, are required. The absence of dispersing aids, if possible, is thus preferable in that case.

When according to this invention e.g. dye dispersions are prepared the said dispersions may comprise more than one dye, whether or not resulting from mixing separate dispersions or co-precipitation and milling, to be incorporated in at least one hydrophilic layer of a silver halide photographic material. In particular at least one oxonol dye is present in the dispersion prepared according to the method of this invention. In a preferred embodiment at least one oxonol dye corresponding to the formula (I), given hereinafter, is present and at least one merostyryl dye corresponding to the formula (II) may be present.

A preferred oxonol dye, for use in dispersed form, the dispersion of which is prepared according to the method of this invention, is represented by the general formula (I)

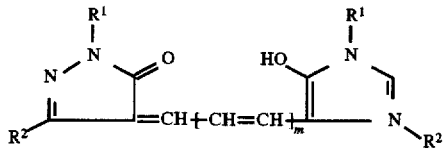

(I)

wherein m=0, 1 or 2;

each of $R^1$ and $R^2$ independently represents hydrogen, (substituted or unsubstituted) alkyl, (substituted or unsubstituted) aryl, $COOR^3$, $NHCOR^4$ or $NHSO_2R^5$ with $R^3$ representing hydrogen or alkyl, each of $R^4$ and $R^5$ independently representing alkyl or aryl, and wherein at least one of $R^1$ and $R^2$ in formula (I) has an ionisable group.

In a preferred embodiment in the formula (I) of the said oxonol dye m=2, $R^1$=p-carboxyphenyl and $R^2$=$CH_3$.

Said oxonol dye(s) has(have) been described e.g. in U.S. Pat. Nos. 4,092,168 and 4,288,534.

Preferred merostryl dyes, which are optionally present, are represented by the general formula (II) given hereinafter

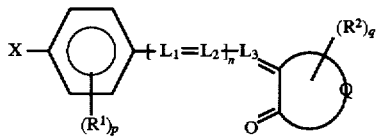

(II)

wherein n represents 0 or 1;

each of p and q independently represents 0, 1 or 2;

Q represents the atoms necessary to form an acidic nucleus;

each of $R^1$ and $R^2$ independently represents hydrogen, (substituted or unsubstituted) alkyl, (substituted or unsubstituted) aryl, $COOR^3$, $NHCOR^4$ or $NHSO_2R^5$ with $R^3$ representing hydrogen or (substituted or unsubstituted) alkyl, each of $R^4$ and $R^5$ independently representing (substituted or unsubstituted) alkyl, or (substituted or unsubstituted) aryl, X represents $OR^6$, $SR^6$ or $NR^7R^8$, wherein $R^6$ represents H, (substituted or unsubstituted) alkyl, (substituted or unsubstituted) aryl and each of $R^7$ and $R^8$ which may be the same or different represents hydrogen, (substituted or unsubstituted) alkyl, (substituted or unsubstituted) aryl or the necessary atoms to form a ring together with the N-atom to which they are attached and the C-atom of the phenylene ring in ortho position with respect to said N-atom; $R^7$ and $R^8$ together may also represent the necessary atoms to form a ring with the N-atom to which they are attached;

$L_1$, $L_2$, $L_3$ represent (substituted or unsubstituted) methine with the proviso that, if substituted, at least one of $L_1$, $L_2$ or $L_3$ must be substituted by —$CONR^9R^{10}$; —$CON(R^{11})$—; —$COOR^9$; —CN;

$R^9$ and $R^{10}$ which may be the same or different represent hydrogen, (substituted or unsubstituted) alkyl, (substituted or unsubstituted) aryl, $R^{11}$ represents atoms to form a ring with an atom of Q, defined hereinbefore;

and wherein at least one of $R^1$ to $R^{11}$ contains an ionisable group. Preferably said ionisable group is situated at $R^2$.

In formula (II) of the said merostyryl dye the acidic nucleus is preferably a pyrazolone, barbituric acid, thiobarbituric acid, rhodanine, hydantoine, oxazolidindione, thiooxazolidindione or an isoxazolinone.

In a further preferred embodiment in formula (II) of the said merostyryl dye, the necessary atoms represented by $L_1$–$L_3$ are mono- or trimethine.

Dyes according to the general formula (II) have been described in e.g. EP-A's 0 586 748; 0 587 230; U.S. Pat. No. 5,344,749 and in EP-A 0 656 401.

The presence of a merostyryl dye, particularly in "microprecipitated-milled" form, may occur in the dispersion mixture as, according to this invention, it is specifically contemplated that the dispersion(s) of e.g. dyes prepared according to the method of this invention are incorporated in at least one hydrophilic colloid layer of a silver halide photographic material wherein the absorption spectrum is in the region from 370 to 700 nm. The amount per sq.m. of the oxonol dye(s) is preferably about 0.1 g, i.a. from 0.09 to 0.11 g. If a more bathochromically absorbing dye is required in order to cover a broader range of the absorption spectrum at least one merostyryl dye can thus be necessary in the dispersion, wherein the amount per sq.m. of the merostyryl dye(s), corresponding to the formula (II) is from 0.1 to 0.3 g. In that case the ratio by weight, of the said at least one merostyryl dye corresponding to the formula (II) and the said at least one oxonol dye corresponding to the formula (I) preferably is from 3:1 to 1:1 in said at least one hydrophilic colloid layer of the silver halide photographic material.

Suitable hydrophilic layers wherein, photographically useful compounds as e.g. dye dispersions, prepared according to the method of this invention are used, are non-light-sensitive as well as light-sensitive layers as in the case of dyes e.g., an antihalation undercoat layer, coated between the support and the silver halide emulsion layer, situated more close to the support; one or more silver halide emulsion layers; one or more interlayers between the silver halide emulsion layers in a multilayer arrangement; in a filter layer between the emulsion layer farthest from the support and a protective layer or in a protective layer which may further be composed of one or more layers. Any combination is possible, depending on the specific requirements for each material. Further ingredients used in the dye containing as well as in the other layers of a silver halide photographic material have been described in Research Disclosures RD 17643, p. 23–28; RD 18716, p. 648–651; RD 308119, p. 996–1009 and RD 36544, p. 501–541, which are incorporated herein by reference. From these ingredients those having ionisable acid sites on their molecules are preferably prepared by the method according to this invention.

Suitable silver halide photographic materials coated from layers wherein dispersions of photographically useful compounds prepared according to the method of this invention can be used are radiographic materials having a multilayer arrangement e.g. as described in EP-Application No. 95201822, filed Jul. 4, 1995, coated on one or both sides of a support; materials for micrography, duplicating materials, materials for use in graphic applications, colour materials etc.

In a particularly preferred embodiment of the present invention, apart from dispersions of photographically useful compounds, dye dispersions are incorporated into non-light sensitive hydrophilic colloid layers of a radiographic material, the said layers being provided at both sides of the support with a silver halide emulsion layer and an antistress layer as a protective antistress layer coated thereover. The radiographic material preferably has on both sides of the film support silver halide emulsion coatings that are split into two distinctive emulsion layers having silver halide crystals of different average grain size one of which is a high speed emulsion layer and the other is a low speed emulsion layer; the high speed emulsion layer being situated at a larger distance from the support than the low speed emulsion layer. In this way the sensitometric curve can be fine-tuned, giving the perfect profile required for the specific application. The layer arrangement may also be opposite to the previously cited sequence in order to get a higher contrast. Moreover even without using a separate anti-crossover layer this layer arrangement reduces cross-over, especially in the critical low density area. In the presence of antihalation undercoat layers preventing cross-over, said layers containing the dispersions, particularly dye dispersions prepared according to the method of this invention, the said cross-over reduction is improved without leaving a colour stain upon processing, especially upon rapid processing in less than 60 seconds, preferably in 45, 38 or 30 seconds as reference processing times of materials with high-throughput.

In single side coated materials, one or more backing layers may be present, one or more of which may comprise dispersions of at least one photographically useful group, prepared according to the method of this invention.

It is further particularly preferred that in order to prevent wandering from dyes from one layer to another that the coating pH has a value of 6.5 or less, preferably from 5.5 to 6.5.

All combinations of symmetrically double-sized film materials with a symmetric or asymmetric set of intensifying screens or combinations of double-sized films with asymmetric emulsion layers, whether or not duplitized, in combination with a symmetric or asymmetric set of intensifying screens are possible, depending on the specific needs, the said materials comprising at least one dispersion of at least one photographically useful compound, prepared by the method according to this invention.

In another embodiment the dye dispersions prepared by the method of this invention are incorporated in optical photoconductive layers, coated from non-aqueous coating solutions.

Suitable supports used for the materials described hereinbefore can be found in the said RD 36544 and in e.g. EP-A 0 619 514. Especially preferred supports are polyethylene terephthalate and polyethylene naphthalate.

The following examples illustrate the present invention and the advantages obtained without however limiting it thereto.

EXAMPLES.

Example 1

Preparation of a dispersion of the fully protonated dye I-1:

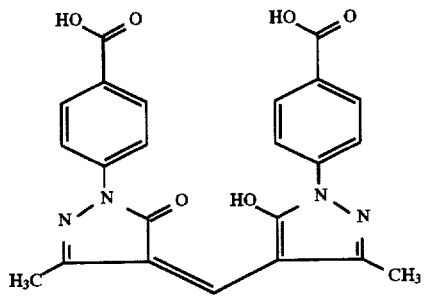

(I-1)

1. Microprecipitation step:

An aqueous stock solution of about 5.2% by weight of dye I-1 was prepared by sprinkling 30 g of the fully protonated dye in about 450 g of distilled water while stirring with an axial-flow impeller. About 99 ml of an aqueous 2N solution of NaOH were added at a rate of about 9 ml per minute in order to give a final pH of about 9. The solution was filtered to remove undissolved contaminants and could be stored for about 24 hours without chemical degradation of the dye I-1.

Microprecipitation was carried out by pouring 54 ml of an aqueous 6N solution of sulphuric acid in the stock solution. While pouring in the aqueous acid the stock solution was stirred with a high shear mixer to create a very effective mixing of the two solutions. After this microprecipitation-step the suspension was heated up to 40° C. while stirring with an axial-flow impellor and about 65 ml of an aqueous 2N solution of NaOH were added to give a final pH value of about 5.2. This suspension was mixed with a solution of 20% by weight of gelatin in water and was subsequently milled in a bead mill to form a stable dispersion. As a milling material zirconium oxide pearls sizing 0.6 to 0.8 μm were used therein.

Comparative dispersion 1:

A comparative dispersion was prepared in the same way as above except for the milling step: no milling in a bead mill was performed after mixing the suspension of the dye I-1 with a solution of 20% by weight of gelatin in water in order to obtain a stable dispersion.

Comparative dispersion 2:

A comparative dispersion was produced by bead milling the fully protonated dye I-1. Water (38 ml), about 2 g of gelatin and about 10 ml of a solution of dispersing agent "Hostapon" (trademarked product from Hoechst, Frankfurt, Germany), 10% by weight, were placed in a reaction vessel. About 5 g of fully protonated dye I-1 were added under stirring with a high shear mixer. This suspension was consecutively milled in a bead mill. The milling time of this comparative dispersion was taken four times longer than the milling time in the example with the microprecipitated protonated dye I-1. The obtained suspension was consecutively admixed with a solution of gelatin, 20% by weight, to obtain a more stable dispersion.

Evaluation of dispersions:

The results are presented in Table 1.

TABLE 1

| Dispersion | Mean Particle Size (in μm) | Number of particles per ml >5 μm |
|---|---|---|
| microprecipitated and milled | 0.420 | 37 000 |
| compar. ex. 1 | 0.437 | 2 640 697 |
| compar. ex. 2 | 0.645 | 141 000 |

It is common knowledge that dispersions of anti-halation dyes with a smaller particle size result in better properties for the coated film.

It is also common knowledge that dispersions of anti-halation dyes with a huge number of particles with a particle size of more than 5 μm result in an excessive number of defects in the coated film as well as in a lower transparency of the film.

When these big particles would be filtered out before forming the coated film, it would result in a lower efficiency in the preparation method of the dye I-1.

Example 2

Preparation of a dispersion of the fully protonated dye II-1:

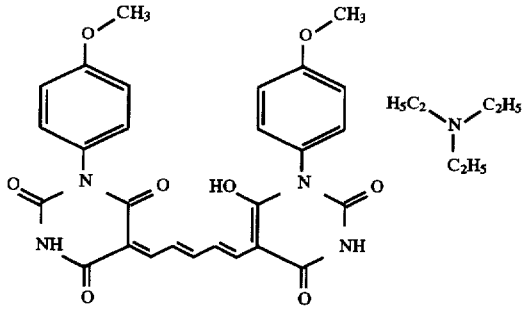

(II-1)

Microprecipitation:

An aqueous stock solution of about 15% by weight of dye II-1 was prepared by the steps of adding 50 ml distilled water and 60 ml of an aqueous solution of 2N NaOH to about 20 g of fully protonated dye II-1. The solution was stirred with an axial-flow impeller while heating up to about 45° C. The final pH was about 12.0. The solution was filtered to remove some undissolved product. Microprecipitation was carried out by pouring 25 ml of a sulphuric acid solution 6N in the stock solution. While pouring in the aqueous acid, the stock solution was heavily stirred with a high shear mixer to create a very effective mixing of the stock solution with the aqueous acid. After this microprecipitation an amount of about 100 ml of distilled water was used to rince the high shear mixer and to obtain a suspension with a lower viscosity. This suspension was added to a solution consisting of about 9.8% by weight of gelatin in water, a dispersing agent in an amount of about 25 ml of a solution (1% by weight) of dispersing agent "Aerosol OT" (trade marked product from American Cyanamid) and about 25 ml of an aqueous 2N solution of NaOH. During addition of the suspension to the solution mixing was achieved with an axial-flow impeller and heated at a temperature of about 45° C. Subsequently the suspension obtained was milled in a bead mill to form a stable dispersion.

Comparative dispersion 3:

A comparative dispersion was produced by bead milling fully protonated dye II-1. A mixture of 57 ml of water and about 100 ml of a solution (1% by weight) of a solution of dispersing agent "Aerosol OT" (trademarked product from American Cyanamid) was prepared. Into this solution an amount of about 20 g of fully protonated dye II-1 was added while stirring with a high shear mixer. This suspension was subsequently milled in a bead mill. The milling time of this comparative dispersion took eight times longer in comparison with the milling time in the example with the microprecipitated protonated dye II-1. The suspension obtained was subsequently admixed with a solution (7.2% by weight) of gelatin to obtain a more stable dispersion.

Evaluation of the dispersions:

The results obtained for the particle size of the filter-dye are presented in Table 2.

TABLE 2

| Dispersion | Mean Particle Size (in μm) | Number of particles per ml > 5 μm |
|---|---|---|
| microprecipitated and milled | 0.249 | 7360 |
| compar. disp. 3 | 0.534 | 27500 |

It is common knowledge that dispersions of filter dyes having a smaller particle size do result in a much higher yield of the dye; consequently a lower amount of dispersed dye is required in order to obtain a sufficient absorption by the said amount of filter dye coated in at least one hydrophilic layer of a photographic material. Moreover the processing time of the said photographic material can be reduced as residual amounts of the dye(s), dispersed according to the method of this invention, are removed more quickly.

Example 3

Preparation of a dispersion of the fully protonated dye III-1 and of the fully protonated dye IV-1:

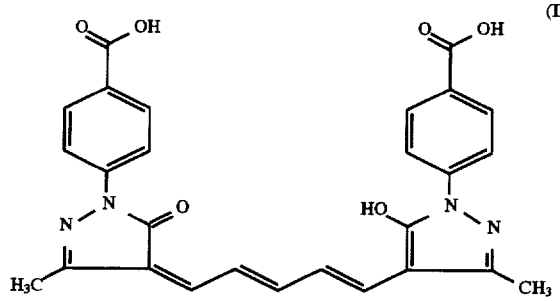

(III-1)

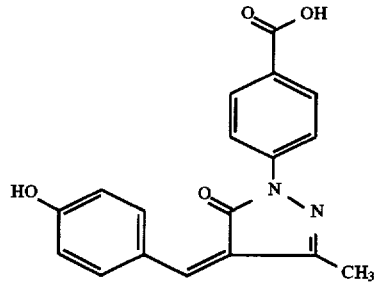

(IV-1)

Microprecipitation:

An aqueous stock solution of about 4% by weight of dye III-1 was prepared by sprinkling 40 g of the fully protonated dye III-1 in about 824 g of distilled water while stirring with an axial-flow impeller. About 176 ml of an aqueous 2N solution of NaOH were added at a rate of about 15 ml per minute in order to reach a final pH value of about 7.5. The solution was filtered to remove undissolved residu and could be stored for about 10 days without chemical degradation of the dye III-1.

An aqueous stock solution of about 6.4% by weight of dye IV-1 was prepared by sprinkling 80 g of the fully protonated dye IV-1 in about 930 g of distilled water while stirring with an axial-flow impellor. About 230 ml of an aqueous 2N solution NaOH were added at a rate of about 15 ml per minute to give a final pH value of about 9.1. The solution was filtered to remove undissolved residu. The aqueous stock solutions of dye IV-1 and of dye III-1 were poured together in volume ratio of 1.25:1.00 and mixed for a while. The microprecipitation was carried out by pouring 114 ml of an aqueous 6N solution of sulphuric acid in the mixture of the stock solutions. During the pouring step the stock solution mixture was stirred with a high shear mixer to create a very effective mixing of the solutions. After this micro-co-precipitation-step the suspension was heated up to 43° C. while stirring with a high shear mixer and about 40 ml of an aqueous 2N solution of NaOH was added to give a final pH of about 5.1. This suspension was mixed with a solution of 24% by weight of gelatin in water and subsequently milled in a bead mill. A stable dispersion was obtained.

Comparative dispersion 4:

A comparative dispersion was produced in the same way as described above without the step of milling in a bead mill. A stable dispersion was also obtained.

Evaluation of the dispersions:

The results are presented in Table 3.

TABLE 3

| Dispersion | Mean Particle Size (in μm) | Number of particles per ml >5 μm |
|---|---|---|
| microprecipitated and milled | 0.388 | 32500 |
| compar. disp. 4 | 0.883 | 86254 |

It is common knowledge that dispersions of filter dyes with a smaller particle size do result in a much higher yield of the dye. The same conclusions as set forth hereinbefore in Example 2 can be drawn from Example 3.

Example 4

4.1. Preparation of a dispersion of the fully protonated dye V-1:

(V-1)

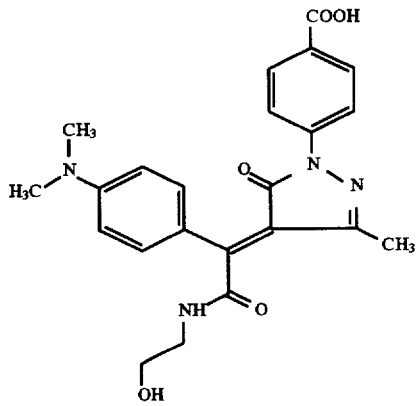

Microprecipitation:

An aqueous stock solution of about 12% by weight of dye I-1 was prepared by adding 5 l of ethanol and about 25 l of distilled water to an amount of 5 kg of the fully protonated dye I-1 whereupon, while stirring, 6.4 l of an aqueous solution of NaOH 2N were added at a rate of about 3 l per minute to give a final pH value of about 10.3. The solution was filtered to remove the undissolved residu and could be stored at least for about 60 minutes without chemical degradation of the dye V-1. Microprecipitation was carried out in a bead mill by pumping in the mill the solution of the dye V-1 at a rate of 490 ml per minute, further simultaneously pumping into the milling apparatus from an adjacent site in the vicinity of the solution of the dye V-1 an aqueous solution of sulphuric acid solution 6N at a rate of 60 ml per minute. Meanwhile the bead mill was stirred at normal operating speed. As a milling material zirconium oxide pearls sizing 0.6 to 0.8 μm were used therein. After the "microprecipitation-milling" process an amount of a 12.8% by weight of a gelatin solution was added in order to solidify the obtained dispersion.

4.2. Operating with same dye V-1 but "microprecipitation-milling" in the presence of a gelatin solution.

An aqueous stock solution was prepared of about 11% by weight of dye V-1 by adding 330 ml of distilled water to an amount of 50 g of fully protonated dye V-1 whereupon while stirring about 72 ml of 2N aqueous NaOH were added at a rate of about 15 ml per minute in order to give a final pH of about 10.8. The solution was filtered to remove some undissolved residu. Hereafter the solution was heated to 45° C. and an amount of 510 ml of an aqueous solution of gelatin (9.7% by weight) was admixed to the solution by an axial-flow impeller. Microprecipitation was carried out in a bead mill under normal operating conditions while circulating the mixture of the solution of the dye V-1 and the gelatin solution at a speed of 2.5 l per minute by pumping in the mill 22.5 ml of an aqueous $H_2SO_4$ solution 6N at a rate of about 60 ml per minute. As a milling material zirconium oxide pearls sizing 0.6 to 0.8 μm were used therein. After a while the suspension was collected and cooled in order to obtain a solidified dispersion.

4.3. Comparative dispersion 5.

A comparative dispersion was produced by making the same mixture of the solution of the dye V-1 and of the aqueous solution of gelatin as in Example 4.2. Microprecipitation was carried out by pouring about 22.5 ml of an aqueous solution of sulphuric acid 6N in the mixture mentioned before. While pouring the aqueous acidic solution the mixture was stirred with a shear mixer to create a very effective mixing of the solutions. After this microprecipitation-step the suspension was subsequently milled in a bead mill in the same operating conditions as set forth in Example 4.2. No microprecipitation was thus performed in the milling device. After cooling a solidified dispersion was obtained.

Evaluation of dispersions:

The results are presented in Table 4.

TABLE 4

| Dispersion | Mean Particle Size (in μm) | Number of particles >5 μm (per ml) |
|---|---|---|
| Example 4.1. | 0.325 | 37500 |
| Example 4.2. | 0.295 | 16750 |
| Comparative 5 | 0.365 | 833700 |

It can be concluded from Table 4 that it is possible to obtain a dispersion having particles with a sufficiently small average mean particle diameter.

It can also be concluded that microprecipitation performed in a milling device yields even smaller average mean particle diameters if compared with microprecipitation, followed in a subsequent step by milling of the separately microprecipitated dispersion.

According to this invention microprecipitation performed in a milling device yields even a smaller number of agglomerated particles as is clear from Table 4. Moreover the number of agglomerates obtained strongly depends on the chemical structure of the photographically useful compounds, as is the case for the dye V-1 used in this example.

Example 5

5.1. Preparation of a dispersion of the fully protonated dye V-1 in the absence of a dispersing aid.

Microprecipitation: same as in Example 4, 4.1.

5.2. Operating with same dye V-1 but "microprecipitation-milling" in the presence of a gelatin solution, added before.

Microprecipitation: same as in Example 4, 4.2.

5.3. Operating with same dye V-1 but "milling after microprecipitation" in the presence of a dispersing aid differing from gelatin, added before microprecipitation.

An aqueous stock solution of about 11% by weight of dye V-1 was prepared by adding 333 ml of distilled water to an amount of 50 ml of fully protonated dye V-1 whereupon, while stirring, about 67 ml of an aqueous solution of NaOH 2N were added at a rate of about 15 ml per minute to give a final pH value of about 10.1. The solution was filtered to remove the undissolved residu and could be stored at least for about 60 minutes without chemical degradation of the dye V-1. An amount of 25 ml of dispersing aid "Alkanol XC", trademarked product from Du Pont, was added to the solution before microprecipitation. Said microprecipitation was carried out by pouring about 22.5 ml 6N aqueous sulphuric acid in the mixture mentioned before. While pouring in the aqueous acid the mixture was stirred with a shear mixer to create a very effective mixing of the solutions. After this microprecipitation-step the suspension was heated up to about 43° C. while stirring with an axial-flow impeller and about 50 ml of a 9.7% by weight gelatin solution was admixed to obtain a solidified dispersion.

Evaluation of dispersions.

The results are presented in Table 5.

In Table 5, the volume ratio refers to the the reference volume, set equal to 1.0 for Example 5.1 before microprecipitation. The volumes obtained for the other Examples before and after microprecipitation are referred thereto.

TABLE 5

| Dispersion | Mean Particle Size (in μm) | Volume ratio before microprecipitation | Volume ratio after microprecipitation |
|---|---|---|---|
| Example 5.1 | 0.352 | 1.00 | 1.05 |
| Example 5.2 | 0.365 | 2.32 | 2.27 |
| Example 5.3 | 0.345 | 1.15 | 1.20 |

It can be seen from Table 5 that it is possible to obtain a dispersion with about the same particle size and, consequently, the same photographic properties. It is also clear that it is, from an economical point of view, most interesting to achieve a microprecipitation in the absence of a dispersing aid as the volume ratio before and after precipitation is always higher when a dispersing aid (see especially 6.2 with gelatin) is present.

Example 6

6.1. Preparation a dispersion of fully protonated dye II-1.

Microprecipitation:

An aqueous stock solution of 15% by weight of dye II-1 was prepared by adding 50 ml of distilled water and 60 ml of an aqueous solution of NaOH 2N to about 20 g of fully protonated dye II-1. The solution was stirred with an axial-flow impeller while heating to about 47° C. The final pH was about 12.0. The solution was filtered to remove some undissolved product. Microprecipitation was carried out by pouring 25 ml of an aqueous solution of sulphuric acid 6N in the stock solution. While pouring the aqueous acid solution, the stock solution was stirred with an axial-flow impeller to create a very effective mixing of the stock solution with the aqueous acid solution. After this microprecipitation about 100 ml of distilled water was used in order to rinse the axial-flow impellor and to obtain a suspension with a lower viscosity. This suspension was added to a solution consisting of about 9.8% by weight of gelatin in water, a dispersing agent in an amount of about 25 ml of a solution (1% by weight) of "Aerosol OT" (trademarked product from American Cyanamid) and about 25 ml of an aqueous solution of NaOH 2N. While adding the suspension to the solution, mixing was achieved with an axial-flow impeller and the mixture was heated to a temperature of about 47° C. Subsequently the obtained suspension was milled in a bead mill to form a stable dispersion. As a milling material zirconium oxide pearls sizing 0.6 to 0.8 μm were used therein.

6.2. A comparative dispersion was produced in the same way as described above in Example 6.1. with the only difference that use was made of a high shear mixer during the microprecipitation.

6.3. A comparative dispersion was produced in the same way as described above in Example 6.1. with the difference that use was made of an ultrasonic device to create a micromixing flow during the microprecipitation.

Evaluation of the dispersions:

The results for the particle size of the filter-dye particles in dispersed form are presented in Table 6.

TABLE 6

| Dispersion (energy input) | Mean Particle Size (in μm) | Standard deviation % s (n = 5) |
|---|---|---|
| 6.1. (axial-flow impeller) | 218.4 | 13.7 |
| 6.2. (high-shear mixer) | 168.0 | 15.3 |
| 6.3. (ultrasonic mixing) | 122.4 | 9.5 |

It has been shown in this Example that it is possible to monitor the mean particle size of the microprecipitate as a function of the mixing device. It is known that the energy per volume which has been put into the microprecipitating vessel by making a choice of the mixing device as mentioned in Table 6 increases from an axial-flow impeller towards an ultrasonic mixing device: as a result the average mean particle size decreases, as well as the average standard deviation thereof if more samples are prepared (five samples were prepared by each mixing technique). As finer dispersion particles result in a much higher yield of the dye, there is a lower amount of dispersion required to obtain a sufficient absorption by the filter dye. Moreover in practical coatings the time of processing of an exposed silver halide photographic film is reduced without the occurrence of residual dye stain.

We claim:

1. Method for preparing a dispersion of a photographically useful compound wherein particle sizes of the said photographically useful compound in dispersed form are from 0.10 to 0.45 μm, wherein said compound has at least one ionizable acid site on its molecule, said method comprising the steps of deprotonizing and solubilizing said compound in alkaline medium, microprecipitating said compound, milling the microprecipitated compound and, coating the formed dispersion of photographically useful compound in a non-light-sensitive and/or light-sensitive hydrophilic layer of a silver halide photographic material, wherein during microprecipitating an input of energy by axial-flow impeller mixing is provided, and wherein milling proceeds during and/or after microprecipitating.

2. Method according to claim 1, wherein the said microprecipitating step is performed in the presence of at least one dispersing agent and/or at least one hydrophilic colloid.

3. Method according to claim 1, wherein a desalting step is performed after the said microprecipitating step.

4. Method according to claim 3, wherein said desalting step is performed by dialysis or ultrafiltration.

5. Method according to claim 1, wherein the said milling step is performed in a ball-mill, sand-mill, pearl-mill, basket-mill or roller-mill apparatus.

6. Method according to claim 1, wherein concentrations of photographically useful compounds in the dispersions are from 0.5 to 15% by weight.

7. Method according to claim 1, wherein the coating pH of the said hydrophilic layers is from 5.5 to 6.5.

8. Method for preparing a dispersion of a photographically useful compound wherein particle sizes of the said photographically useful compound in dispersed form are from 0.10 to 0.45 μm, wherein said compound has at least one ionizable acid site on its molecule, said method comprising the steps of deprotonizing and solubilizing said compound in alkaline medium, microprecipitating said compound, milling the microprecipitated compound, coating the said dispersion of photographically useful compound in a non-light-sensitive and/or light-sensitive hydrophilic layer of a silver halide photographic material, wherein milling proceeds during and/or after the microprecipitating step, and wherein during and/or after microprecipitating and/or milling an ultrasound treatment step is performed.

9. Method according to claim 8, wherein the said microprecipitating step is performed in the presence of at least one dispersing agent and/or at least one hydrophilic colloid.

10. Method according to claim 8, wherein a desalting step is performed after the said microprecipitating step.

11. Method according to claim 8, wherein said desalting step is performed by dialysis or ultrafiltration.

12. Method according to claim 8, wherein the said milling step is performed in a ball-mill, sand-mill, pearl-mill, basket-mill or roller-mill apparatus.

13. Method according to claim 8, wherein concentrations of photographically useful compounds in the dispersions are from 0.5 to 15% by weight.

14. Method according to claim 8, wherein the coating pH of the said hydrophilic layers is from 5.5 to 6.5.

* * * * *